US010377968B2

(12) United States Patent
Brooks et al.

(10) Patent No.: US 10,377,968 B2
(45) Date of Patent: Aug. 13, 2019

(54) CLEANING COMPOSITIONS AND METHODS FOR REMOVING OXIDES FROM SUPERALLOY SUBSTRATES

(71) Applicant: General Electric Company, Schenectady, NY (US)

(72) Inventors: William Clarke Brooks, Lebanon, OH (US); Eric Scott Huron, West Chester, OH (US); John Matthew Powers, Independence, KY (US); Ian Thomas Goodall, Cincinnati, OH (US); Evan Jarrett Dolley, Jr., Niskayuna, NY (US); David Edward Trider, Cincinnati, OH (US); Zeynep Bolukoglu, Istanbul (TR); Doga Ulutas, Istanbul (TR); Tugba Aydin, Istanbul (TR)

(73) Assignee: General Electric Company, Schenectady, NY (US)

( * ) Notice: Subject to any disclaimer, the term of this patent is extended or adjusted under 35 U.S.C. 154(b) by 2 days.

(21) Appl. No.: 15/619,990

(22) Filed: Jun. 12, 2017

(65) Prior Publication Data

US 2018/0355492 A1 Dec. 13, 2018

(51) Int. Cl.
*C11D 3/39* (2006.01)
*C11D 3/04* (2006.01)
(Continued)

(52) U.S. Cl.
CPC ..... *C11D 3/046* (2013.01); *C11D 3/042* (2013.01); *C11D 3/3947* (2013.01);
(Continued)

(58) Field of Classification Search
CPC ... C11D 7/08; C11D 11/0041; C11D 11/0039; C23G 1/02; C23G 1/14
(Continued)

(56) References Cited

U.S. PATENT DOCUMENTS 2,106,227 A 1/1938 Scharschu
2,318,559 A 5/1943 Percival
(Continued)

FOREIGN PATENT DOCUMENTS

CN 1136336 C 1/2004
GB 2421736 A 7/2006
(Continued)

OTHER PUBLICATIONS

Thoma, "Hydrogen Embrittlement and Stress Corrosion Cracking of Titanium Alloys Caused by Cleaning Processes," SAE Technical Paper 850709, 1985, http://papers.sae.org/850709/ doi:10.4271/850709-(Abstract only).
(Continued)

*Primary Examiner* — Gregory E Webb
(74) *Attorney, Agent, or Firm* — Dority & Manning, P.A.

(57) ABSTRACT

Methods for cleaning a superalloy substrate having engine deposits on its surface are provided. The method may include applying a permanganate solution onto the surface of the superalloy substrate, and applying a ferric chloride based cleaning composition onto the surface of the superalloy substrate. The ferric chloride based cleaning composition includes ferric chloride and at least one of nitric acid and phosphoric acid, such as within a solvent system (e.g., an aqueous solution including water).

20 Claims, 6 Drawing Sheets

(51) Int. Cl.

| | |
|---|---|
| ***C11D 11/00*** | (2006.01) |
| ***C23G 1/00*** | (2006.01) |
| ***C23G 1/08*** | (2006.01) |
| ***C23G 1/19*** | (2006.01) |
| ***F01D 25/00*** | (2006.01) |

(52) U.S. Cl.
CPC ..... *C11D 11/0029* (2013.01); *C23G 1/00* (2013.01); *C23G 1/085* (2013.01); *C23G 1/19* (2013.01); *F01D 25/002* (2013.01); *F05D 2230/72* (2013.01); *F05D 2300/175* (2013.01)

(58) Field of Classification Search
USPC ..... 134/2, 3; 510/185, 245, 254, 253
See application file for complete search history.

(56) References Cited

U.S. PATENT DOCUMENTS

| | | | | |
|---|---|---|---|---|
| 4,339,282 | A | 7/1982 | Lada et al. | |
| 4,655,383 | A * | 4/1987 | Fournes | B23K 1/206 228/119 |
| 4,707,191 | A * | 11/1987 | Martinou | C23G 1/00 134/28 |
| 5,016,810 | A | 5/1991 | Sikka | |
| 5,176,499 | A | 1/1993 | Damlis et al. | |
| 5,944,909 | A * | 8/1999 | Reeves | C23F 1/44 134/28 |
| 6,454,870 | B1 | 9/2002 | Brooks | |
| 6,494,960 | B1 | 12/2002 | Macdonald et al. | |
| 6,575,817 | B2 | 6/2003 | Czech | |
| 6,652,914 | B1 | 11/2003 | Langley et al. | |
| 7,018,965 | B2 | 3/2006 | Yan et al. | |
| 7,115,171 | B2 | 10/2006 | Powers et al. | |
| 7,513,986 | B2 | 4/2009 | Albrecht et al. | |
| 7,575,694 | B2 | 8/2009 | Kool et al. | |
| 8,038,894 | B2 | 10/2011 | Brooks | |
| 8,062,431 | B2 | 11/2011 | Kumar et al. | |
| 8,876,978 | B2 | 11/2014 | Kawakami et al. | |
| 9,212,555 | B2 | 12/2015 | Manier et al. | |
| 2007/0125459 | A1 | 6/2007 | Gupta et al. | |
| 2008/0102292 | A1 | 5/2008 | Vontell et al. | |
| 2009/0302004 | A1 | 12/2009 | Manier et al. | |
| 2010/0326466 | A1 | 12/2010 | Kawakami et al. | |
| 2012/0168320 | A1 | 7/2012 | Bland et al. | |
| 2018/0094217 | A1 * | 4/2018 | Dolley | C11D 7/08 |

FOREIGN PATENT DOCUMENTS

| | | | |
|---|---|---|---|
| JP | 2012062834 | A | 3/2012 |
| WO | WO 00/70125 | | 11/2000 |
| WO | WO2012082004 | A1 | 6/2012 |

OTHER PUBLICATIONS

Thoma, "Hydrogen Embrittlement and Stress Corrosion Cracking of Titanium Alloys Caused by Cleaning Processes," SAE Technical Paper 850709, 1985, http://papers.sae.org/850709/ doi: 10.4271/850709.

* cited by examiner

CLEANING COMPOSITIONS AND METHODS FOR REMOVING OXIDES FROM SUPERALLOY SUBSTRATES

FIELD

This invention relates broadly to a method for removing engine deposits from turbine components, in particular turbine and compressor disks and shafts and rotating seals, using a cleaning composition. This invention further broadly relates to a cleaning composition for use in this method that comprises a ferric chloride solution.

BACKGROUND

In an aircraft gas turbine engine, air is drawn into the front of the engine, compressed by a shaft-mounted compressor, and mixed with fuel. The mixture is burned, and the hot exhaust gases are passed through a turbine mounted on the same shaft. The flow of combustion gas turns the turbine by impingement against the airfoil section of the turbine blades, which turns the shaft and provides power to the compressor. The hot exhaust gases flow from the back of the engine, driving it and the aircraft forward. The hotter the combustion and exhaust gases, the more efficient is the operation of the jet engine. Thus, there is incentive to raise the combustion gas temperature.

The turbine engine includes compressor disks and turbine disks (sometimes termed "compressor rotors" and "turbine rotors") and/or turbine shafts and other rotating parts. A number of blades are mounted to the turbine disks/shafts and extend radially outwardly therefrom into the gas flow path. As the maximum operating temperature of the turbine engine increases, the turbine disks/shafts, rotating seal elements, frames, cases, and static seal elements are subjected to higher temperatures. As a result, oxidation and corrosion of the disks/shafts and seal elements have become of greater concern.

Turbine disks/shafts and rotating seals for use at the highest operating temperatures are typically made of nickel and/or cobalt-base superalloys selected for good elevated temperature toughness and fatigue resistance. They have resistance to oxidation and corrosion damage, but that resistance is not sufficient to protect them at the operating temperatures now being reached. Over time, engine deposits, primarily in the form of nickel oxides and/or aluminum oxides, can form a coating or layer on the surface of these turbine components. These engine deposits typically need to be cleaned off or otherwise removed.

However, chemical methods of cleaning turbine engine components to remove engine deposits on the surface thereof often adversely affect or alter the properties of the base metal of the cleaned turbine component, especially when this turbine component comprises a nickel and/or cobalt-containing base metal. Additionally, these chemical cleaning processes also usually have to be repeated several times and/or the chemically treated component requires excessively abrasive mechanical cleaning, for example, by aggressive grit blasting, to provide appropriate clean surface conditions for the turbine component. However, it has been found that excessive chemical cleaning increases the amount of processing time to achieve the desired surface conditions, while aggressive abrasive mechanical cleaning is labor intensive and requires great care to avoid excessive removal of the surface base metal that can alter the desired dimensional geometry of the turbine component.

Additionally, certain chemical compositions that have been used to clean and remove engine deposits from the surface of the turbine component can also excessively etch the surface of the nickel and/or cobalt-containing base metals used in making the turbine component. For example, it has found that chemical etchant compositions comprising acetic acid can cause undesired intergranular attack (i.e., at the grain boundaries) of the nickel and/or cobalt-containing base metal of the turbine component. Such intergranular attack can undesirably weaken the base metal at these grain boundaries.

Accordingly, it would be desirable to be able be able to effectively and efficiently clean and remove engine deposits, especially engine deposits comprising metal oxides, from turbine components that comprise nickel and/or cobalt-containing base metals. It would be especially desirable to be able to clean and remove such engine deposits in a manner that does not excessively or substantially remove or alter the nickel and/or cobalt-containing base metal of the turbine component.

BRIEF DESCRIPTION

Aspects and advantages will be set forth in part in the following description, or may be obvious from the description, or may be learned through practice of the invention.

Methods are generally provided for cleaning a superalloy substrate having engine deposits on its surface. In one embodiment, the method includes applying a permanganate solution onto the surface of the superalloy substrate, and applying a ferric chloride based cleaning composition onto the surface of the superalloy substrate. The ferric chloride based cleaning composition includes ferric chloride and at least one of nitric acid and phosphoric acid, such as within a solvent system (e.g., an aqueous solution including water). In one embodiment, the ferric chloride based cleaning composition includes ferric chloride, nitric acid, and phosphoric acid.

The method may include a repeating series of applying the permanganate solution onto the surface of the superalloy substrate and then applying the ferric chloride based cleaning composition onto the surface of the superalloy substrate.

These and other features, aspects and advantages will become better understood with reference to the following description and appended claims. The accompanying drawings, which are incorporated in and constitute a part of this specification, illustrate embodiments of the invention and, together with the description, serve to explain certain principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
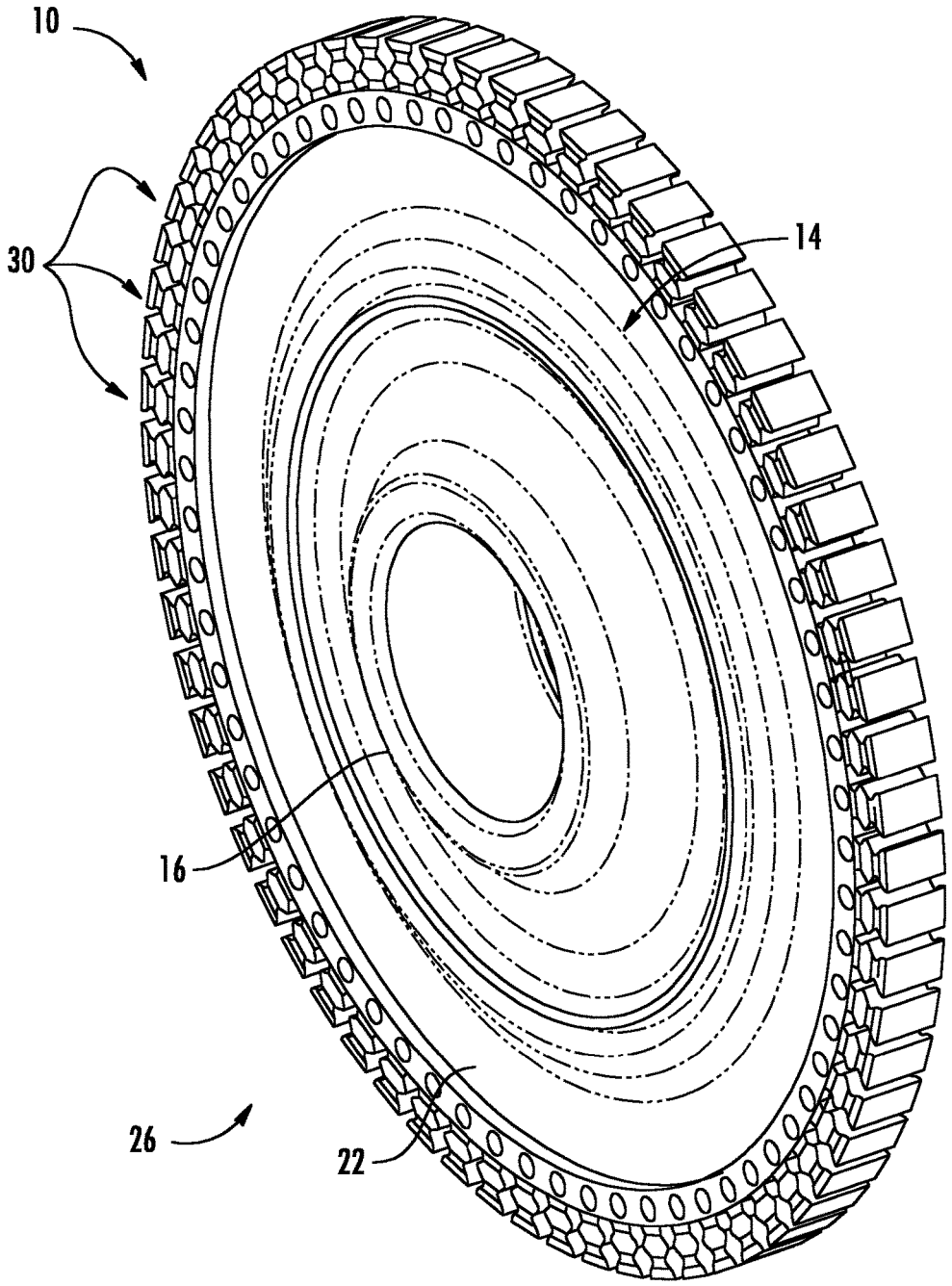
FIG. 1 shows an exemplary turbine disk for which the cleaning methods described herein is particularly useful.

Repeat use of reference characters in the present specification and drawings is intended to represent the same or analogous features or elements of the present invention.

DETAILED DESCRIPTION OF PARTICULAR EMBODIMENTS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

As used herein, the term "turbine component" refers to a wide variety of turbine engine (e.g., gas turbine engine) parts and components that comprise a nickel and/or cobalt-containing base metal, and which can have engine deposits formed on the surface thereof during normal engine operation that can require removal. These turbine engine parts and components can include turbine disks and shafts, turbine airfoils such as turbine blades and vanes, turbine shrouds, turbine nozzles, combustor components such as liners, deflectors and their respective dome assemblies, augmenter hardware of gas turbine engines, etc. The method and composition of this invention are particularly useful in removing engine deposits from the surfaces of turbine disks and turbine shafts.

As used herein, the term "engine deposits" refers to those deposits that form over time during the operation of a gas turbine engine as a coating, layer, crust, etc., on the surface of turbine component. These engine deposits typically comprise oxides of the base metal, for example, nickel oxides, cobalt oxides, etc., oxides of other metal contaminants, for example, aluminum oxides, etc., or combinations thereof.

As used herein, the term "without substantially etching the base metal" means that there is minimal or no etching of the surface of base metal of the turbine component. This etching typically exhibits itself, when viewed under appropriate magnification (e.g., 1000×) as a corroding or pitting of or in the surface of the base metal of the turbine component, so as to form grooves, channels, crevices, etc., therein.

As used herein, the term "in a manner that does not substantially alter the surface thereof" means that there is about a 0.05 mil (1 micron) or less stock loss of the base metal from the surface of the turbine component. As used herein, the term "stock loss" refers to a decrease in or loss of base metal from the surface of the turbine component.

Methods and compositions are generally provided for cleaning the surface of a turbine engine component comprising nickel and/or cobalt-containing base metals. While the present description is related primarily for rotating parts, similar Ni-base and Co-base superalloys are used for the static frame, case, and seal parts in the hottest sections of the engine. As such, the methods and compositions described herein can also be used for cleaning any such static parts.

In certain embodiments, the component includes a metal, such as a nickel-based superalloy, a cobalt-based superalloy, a steel such as stainless steel, a titanium alloy, or other metal commonly used in machine components. In certain embodiments, the article includes a superalloy, meaning a nickel-based superalloy, iron-based superalloy or cobalt-based superalloy; in particular embodiments, the article includes a nickel-based superalloy. Illustrative nickel and/or cobalt-based superalloys are designated by the trade names INCONEL (e.g., INCONEL 718), NIMONIC, RENE (e.g., RENE 88, RENE 104 alloys), HAYNES, and UDIMET. For example, an alloy that can be used in making turbine disks, turbine shafts, and other useful components is a nickel-based superalloy available under the trade name INCONEL 718 that has a nominal composition, by weight, of 52.5% nickel, 19% chromium, 3% molybdenum, 3.5% manganese, 0.5% aluminum, 0.45% titanium, 5.1% combined tantalum and niobium, and 0.1% or less carbon, with the balance being iron. As another example, a nickel-based superalloy available under the trade name RENE 88DT has a nominal composition, by weight, of 13% cobalt, 16% chromium, 4% molybdenum, 4% tungsten, 2.1% aluminum, 3.7% titanium, 0.7% niobium, 0.03% carbon, and 0.015% boron. As used herein, the term "nickel and/or cobalt-containing base metal" refers to a base metal that comprises nickel, cobalt, nickel and cobalt alloys, as well as alloys of nickel and/or cobalt with other metals such as iron, tungsten, molybdenum, chromium, manganese, titanium, aluminum, tantalum, niobium, zirconium, etc.

Generally, a ferric chloride based cleaning composition is utilized with the method. The ferric chloride based cleaning composition may also include, in certain embodiments, nitric acid and/or phosphoric acid. In one embodiment, the ferric chloride based cleaning composition converts the engine deposits on the surface of the turbine component to a removable smut without substantially etching the surface of the turbine component's base metal.

Figure 2:
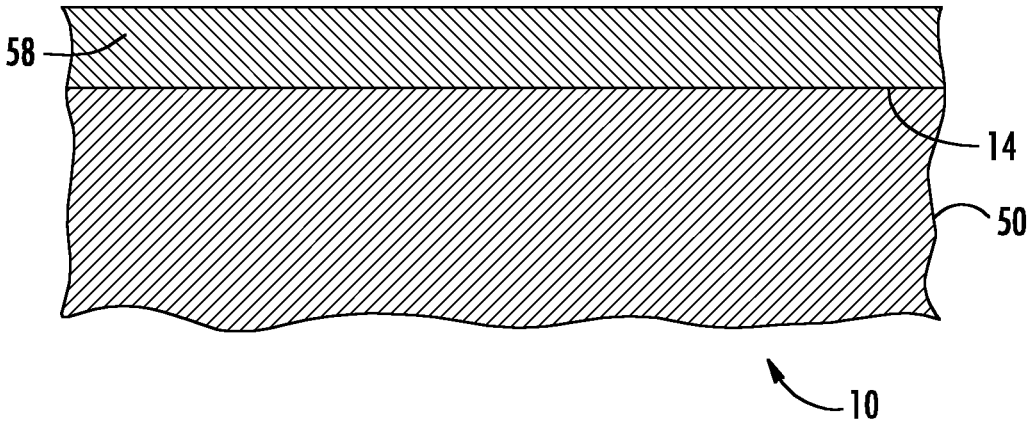
FIG. 2 is an enlarged sectional view of a portion of a turbine disk of FIG. 1 showing engine deposits on the surface thereof.
Figure 3:
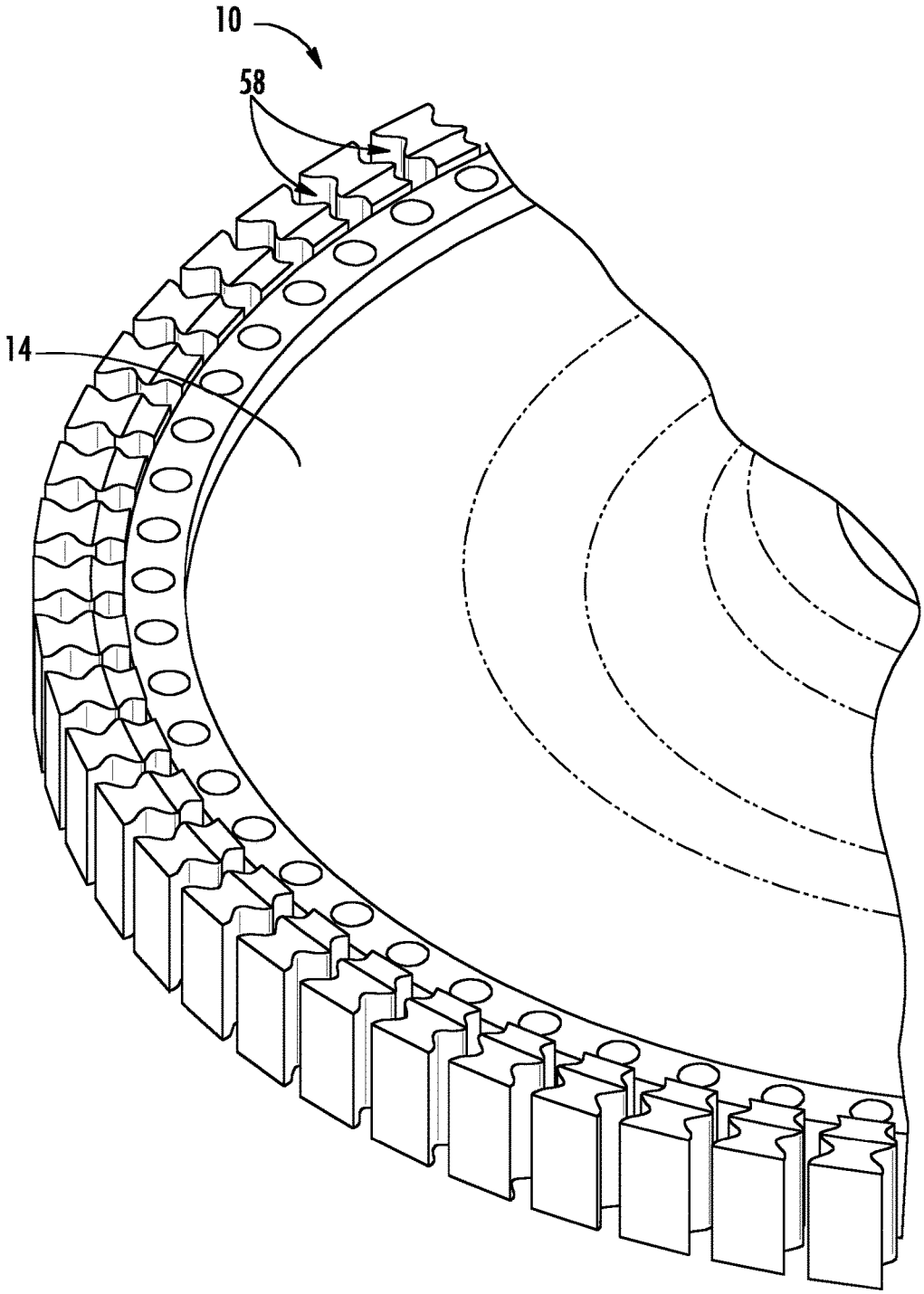
FIG. 3 is an illustration of a portion of a turbine disk of FIG. 1 having engine deposits on the surface thereof.
Figure 4:
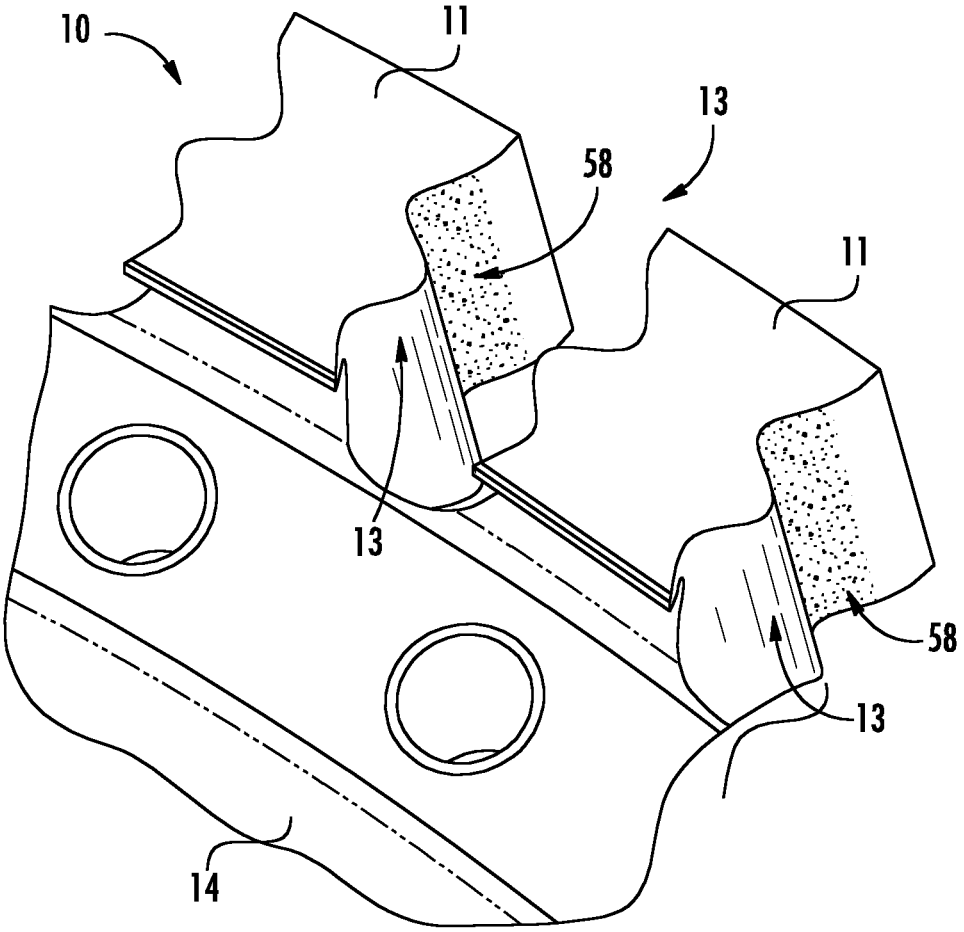
FIG. 4 shows an enlarged portion of the turbine disk of FIG. 3.

Referring to the drawings, FIG. 1 shows a representative turbine component for which the methods and compositions described herein is particularly useful. The turbine component is shown in the form of a turbine disk 10 and having a surface 14. Disk 10 has an inner generally circular hub portion 18 and an outer generally circular perimeter or diameter 22, and a periphery 26 that is provided with a plurality of circumferentially spaced slots 30 that each receive the root portion of a turbine blade (not shown). FIG. 2 shows a sectional view of disk 10 of FIG. 1 comprising a base metal 50 having engine deposits 58 formed on surface 14. These engine deposits 58 tend to form on surface 14 of disk 10 in the area of hub portion 18 and outer diameter 22, and to a more limited extent in the proximity of periphery 26. FIG. 3 illustrates a turbine disk 10 having such engine deposits 58. These engine deposits 58 are particularly illustrated in an enlarged portion of this turbine disk 10 shown in FIG. 4, and typically appear as a dark or darker scale on the surface 14 of turbine disk 10. In the particular embodiment shown, the engine deposits 58 are positioned on the interface surface 13 of the disk 10 where slots 13 are defined by the disk arms 11. The interface surface 13 contacts a dovetail of a turbine blade (not shown).

Figure 6:
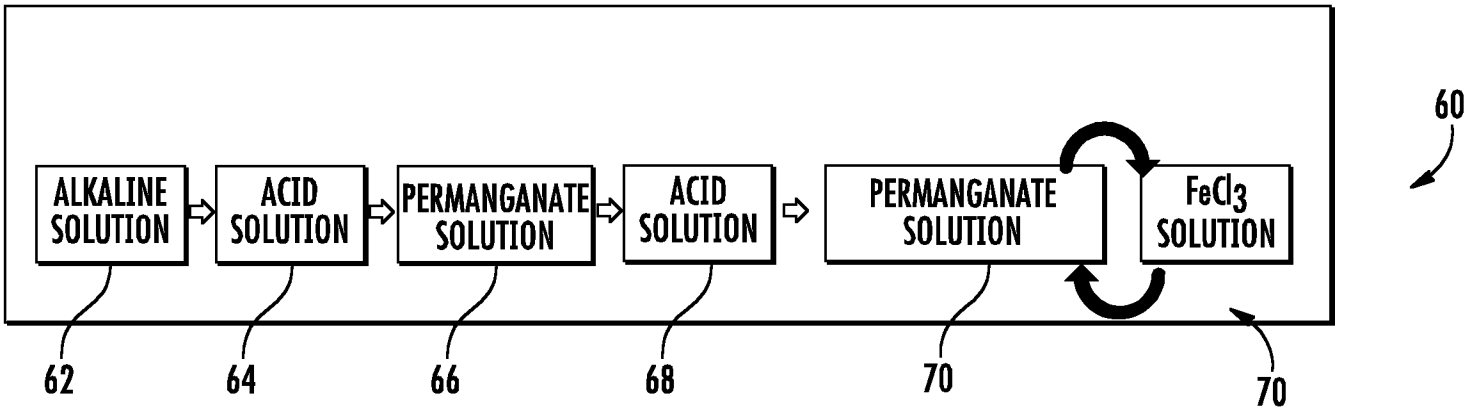
FIG. 6 is a diagram of an exemplary method of cleaning a superalloy substrate.

In one embodiment of the presently disclosed methods, the turbine component such as turbine disk 10 having engine deposits 58 on surface 14 thereof is treated with a ferric chloride based cleaning composition. In particular, the ferric chloride based cleaning composition is utilized in a series of treatment steps that are sequentially performed. Referring to FIG. 6, a diagram of an exemplary method 60 for cleaning a superalloy substrate having engine deposits on its surface. In the embodiment shown, sequential cleaning solutions are applied according to the method 60 at steps 62, 64, 66, 68. In one embodiment, the treatment solutions in application steps 62, 64, 66, 68 may be immersed or otherwise submersed within the treatment solution.

In 62, an alkaline solution is applied onto the surface of the superalloy substrate having engine deposits. In one embodiment, the alkaline solution has a pH at treatment conditions of about 13 to about 14. The alkaline solution in step 62 may clean the surface and may condition oxides within the engine deposits by transforming them into soluble components capable of being removed by subsequent acid baths. For example, the superalloy substrate may be immersed into the alkaline solution at a temperature of about 80° C. to about 95° C. (e.g., about 82° C. to about 93° C.) for a treatment time of about a minute to about an hour (e.g., about 5 minutes to about 35 minutes). In one particular embodiment, the alkaline solution includes sodium hydroxide, either alone or in combination with other base materials, such as triethanolamine, diethanolamine, potassium hydroxide, or mixtures thereof. For example, suitable sodium hydroxide solutions are available commercially: Ardox® 185 or Ardox® 185L (Chemetall GmbH, Frankfurt Germany), Turco 4181L (Henkel Corporation, Madison Heights Mich.), HDP-2888 (MagChem Inc., Boucherville, QC), Cee-Bee> J-84A and J-84AL (McGean-Rohco, Inc., Cleveland, Ohio), and Eldorado HTP-1150 and HTP-1150L (Eldorado Chemical Co., Inc., San Antonio, Tex.).

In 64, an acid solution is applied onto the surface of the superalloy substrate having engine deposits. Generally, the acid solution is utilized to descale the oxides of the engine deposits. That is, the acid solution may react with the conditioned oxides of the engine deposits to begin the process of removal. In one embodiment, the acid solution has a pH at treatment conditions of about 0 to about 5. For example, the superalloy substrate may be immersed into the acid solution at a temperature of about 45° C. to about 90° C. (e.g., about 75° C. to about 90° C.) for a treatment time of about a minute to about an hour (e.g., about 5 minutes to about 35 minutes). In one embodiment, the acid solution includes nitric acid, hydrochloric acid, acetic acid, phosphoric acid, hydrofluoric acid, sulfuric acid, or mixtures thereof. It is noted that the acid solution includes, in one particular embodiment, nitric acid. For example, suitable acid solutions are available commercially: Ardrox 1871 or 1873 or 1873A (Chemetall GmbH, Frankfurt Germany), Turco® Scale Gon #5 (Henkel Corporation, Madison Heights Mich.), AP-988 (MagChem Inc., Boucherville, QC), Eldorado AC-111 (Eldorado Chemical Co., Inc., San Antonio, Tex.), and Cee-Bee® J-3 (McGean-Rohco, Inc., Cleveland, Ohio).

In 66, an alkaline permanganate solution is applied onto the surface of the superalloy substrate having engine deposits. Generally, the permanganate solution is utilized to scale condition the oxides of the engine deposits. That is, the permanganate solution may react with the oxides of the engine deposits to condition them for removal. In one embodiment, the alkaline permanganate solution comprises permanganate in a concentration of at least about 25% by weight and has a pH of greater than about 14. The alkaline permanganate conditioning solution comprises a permanganate such as potassium permanganate or sodium permanganate, produced by the addition of a hydroxide such as potassium hydroxide or sodium hydroxide. For example, the superalloy substrate may be immersed into the permanganate solution at a temperature of about 70° C. to about 95° C. for a treatment time of about a minute to about an hour (e.g., about 5 minutes to about 35 minutes). For example, suitable permanganate solutions are available commercially: Turco® 4338 or 4338-L or 4338-C (Henkel Corporation, Madison Heights Mich.), Ardrox 188 or 188RFU (Chemetall GmbH, Frankfurt Germany), HDP-2524 (MagChem Inc., Boucherville, QC), Eldorado HTP-1190 or HTP-1190L (Eldorado Chemical Co., Inc., San Antonio, Tex.), and Cee-Bee® J-88 or J-88L (McGean-Rohco, Inc., Cleveland, Ohio).

In 68, an acid solution is applied onto the surface of the superalloy substrate having engine deposits. The acid solution in step 68 may be independently selected from the acid solutions described above with respect to step 64.

After these sequential steps 62, 64, 66, 68, a series 70 of treatment steps 72, 74 is performed for at least 1 cycle. At 72, a permanganate solution is applied onto the surface of the superalloy substrate having engine deposits to generally condition the oxides of the engine deposits for removal. The permanganate solution in step 72 may be independently selected from the permanganate solutions described above with respect to step 66.

At 74, a ferric chloride based cleaning composition is applied onto the surface of the superalloy substrate having engine deposits. The ferric chloride based cleaning composition comprises an aqueous solution that comprises: a ferric chloride and at least one of nitric acid and phosphoric acid. In a particular embodiment, the ferric chloride based cleaning composition comprises ferric chloride, nitric acid, and phosphoric acid. In one embodiment, the pH of the ferric chloride based cleaning composition is about 1.0 to about 2.0, such as about 1.0 to about 1.5.

The ferric chloride is present in a sufficient amount to interact with the tenacious oxide on the surface of the superalloy substrate. However, if the ferric chloride is present in too high of a concentration, the ferric chloride may attack the underlying superalloy material and cause harm to the component. For example, the ferric chloride may be present in the ferric chloride based cleaning composition in an amounts of about 130 g/L to about 160 g/L ferric chloride (e.g., about 140 g/L to about 160 g/L).

Nitric acid is also included in the ferric chloride based cleaning composition, and generally serves as a strong acid, which in the presence of $Cl^-$, helps to removes and/or dissolves oxides from the surface, such as Cr oxides, Ni oxides, and others. In particular embodiments, the ferric chloride based cleaning composition includes about 95 g/L to about 115 g/L of nitric acid.

Phosphoric acid is also included in the ferric chloride based cleaning composition, and serves as an inhibitor to minimize the chemical attack on the base metal in the presence of the nitric acid and ferric chloride components. However, too much phosphoric acid may have an impact on the underlying superalloy material. In particular embodiments, the ferric chloride based cleaning composition includes about 115 g/L to about 145 g/L of phosphoric acid.

The surface 14 of turbine disk 10 having the engine deposits 58 thereon can be treated with the series 70 of treatment steps in any suitable manner, for a period of time sufficient to, and for a number of cycles of series 70 in order to: (1) convert or substantially convert engine deposits 58 on the surface 14 of disk 10 to a removable smut; (2) without substantially etching base metal 50 of disk 10. Treatment can be carried out on surface 14 of turbine disk 10 by any suitable method, but is in one embodiment performed by soaking, dipping or immersing the surface 14 in the cleaning composition, etc. Typically, treatment is carried out by soaking surface 14 of turbine disk 10 with, or immersing surface 14 of turbine disk 10 in, the cleaning composition. For example, a circular tank with an inner diameter seal may be utilized, so that fluid does not touch the inner bottom portion of the disk. In one embodiment, the tank may be configured to hold the treatment solutions and prevent it from contacting undesirable regions in the disk. For instance, the circular tank may include a bottom seal that is movable within the tank to control which portions of the disk contacts the cleaning compositions.

Treatment with the cleaning composition is typically carried out for a period of from about 1 to about 30 minutes. Treatment can be carried out at room temperature (e.g., from about 20° to about 25° C.), or at more elevated temperatures (e.g., up to about 55° C., or up to about 50° C.).

As stated above, the surface 14 of disk 10 can be subjected to other pretreatment steps prior to cleaning with the cleaning composition. For example, the surface 14 of disk 10 can be pretreated to remove or breakdown any oily or other carbonaceous deposits, to aid in the breakdown or removal of any engine deposits 58 thereon by subsequent treatment with the cleaning composition of this invention, etc. For example, surface 14 can be pretreated with an alkaline degreaser composition such as sodium hydroxide.

After treatment of turbine disk 10 with the cleaning composition of this invention, any residue thereof on surface 14 of disk 10 can be rinsed off (e.g., with water), neutralized or otherwise removed by methods known to those skilled in the art. Typically, disk 10 is immersed in water, followed by a high pressure water rinse and drying thereof to remove any of the residual cleaning composition from surface 14. Alternatively, treatment of disk 10 with the cleaning composition can be halted periodically (e.g., every from about 3 to about 5 minutes), with the residual cleaning composition on surface 14 of disk 10 being rinsed off and/or neutralized.

Figure 5:
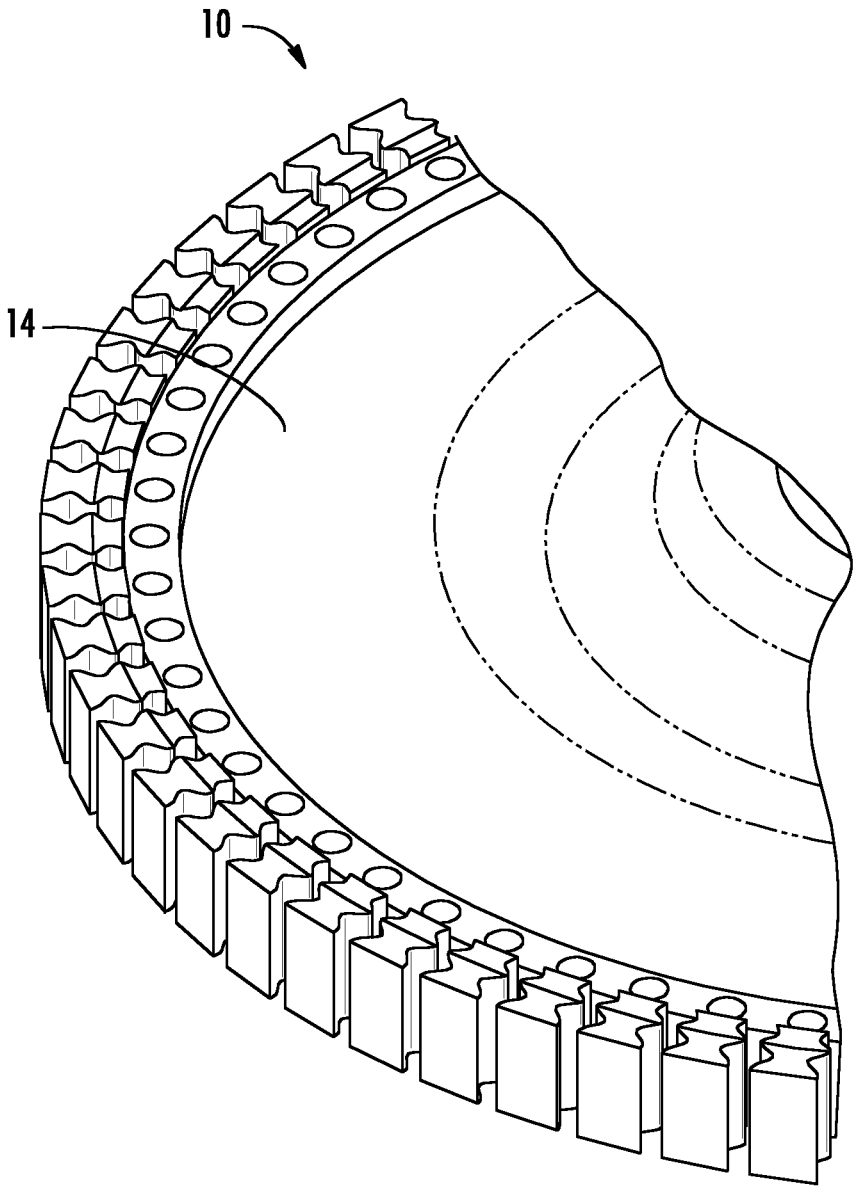
FIG. 5 is an illustration of a portion of the turbine disk of FIG. 1 after cleaning by an embodiment of the composition and method of this invention.

The treatment of turbine disk 10 with the cleaning composition of this invention typically forms or generates a relatively thin residue film, layer, etc., of a removable smut on the treated surface 14 of disk 10. This smut that is formed can be removed or substantially removed from surface 14 of disk 10 in any manner that does not substantially alter surface 14 of disk 10. For example, this smut layer or film can be removed by conventional methods known to those skilled in the art for gently removing similar smut layers or films. The turbine disk 10, after treatment with a cleaning composition of this invention, and after removal of the smut that is formed, is typically substantially free of engine deposits, i.e., there is no visible dark or darker scale on surface 14. See FIG. 5 which shows turbine disk 10 to be substantially free of engine deposits 58 after cleaning of surface 14 according to the method 60 of FIG. 6.

As used herein, the term "comprising" means the various compositions, compounds, components, steps, etc., can be conjointly employed in this invention. Accordingly, the term "comprising" encompasses the more restrictive terms "consisting essentially of" and "consisting of."

This written description uses exemplary embodiments to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of cleaning a superalloy substrate having engine deposits on its surface, the method comprising:

applying an alkaline solution to the surface of the superalloy substrate;

thereafter, applying an acid solution to the surface of the superalloy substrate, wherein the acid solution comprises a citrate-based organic acid;

thereafter, applying a permanganate solution onto the surface of the superalloy substrate; and applying a ferric chloride based cleaning composition onto the surface of the superalloy substrate, wherein the ferric chloride based cleaning composition comprises ferric chloride and at least one of nitric acid and phosphoric acid.

2. The method of claim 1, wherein the ferric chloride based cleaning composition comprises ferric chloride, nitric acid, and phosphoric acid.

3. The method of claim 1, wherein the ferric chloride based cleaning composition further comprises a solvent system.

4. The method of claim 3, wherein the solvent system comprises water.

5. The method of claim 3, wherein the ferric chloride based cleaning composition consists of ferric chloride, nitric acid, phosphoric acid, and the solvent system.

6. The method of claim 1, wherein the ferric chloride based cleaning composition comprises about 130 g/L to about 160 g/L ferric chloride, about 95 g/L to about 115 g/L nitric acid, and about 115 g/L to about 145 g/L phosphoric acid.

7. The method of claim 1, wherein the ferric chloride based cleaning composition comprises about 140 g/L to about 160 g/L ferric chloride, about 95 g/L to about 115 g/L nitric acid, and about 115 g/L to about 145 g/L phosphoric acid.

8. The method of claim 1, wherein the superalloy substrate comprises a nickel-containing base metal or a cobalt-containing base metal.

9. The method of claim 1, further comprising:

repeating a series of applying the permanganate solution onto the surface of the superalloy substrate and then applying the ferric chloride based cleaning composition onto the surface of the superalloy substrate.

10. The method of claim 9, wherein the permanganate solution comprises potassium permanganate, sodium permanganate, or a mixture thereof.

11. The method of claim 10, wherein the permanganate solution further comprises sodium hydroxide.

12. The method of claim 1, wherein the alkaline solution comprises sodium hydroxide, sodium gluconate, and a surfactant.

13. The method of claim 1, wherein applying the ferric chloride based cleaning composition onto the surface of the superalloy substrate comprises immersing the superalloy substrate into the ferric chloride based cleaning composition.

14. A method of cleaning a superalloy substrate having engine deposits on its surface, the method comprising:

applying an alkaline solution to the surface of the superalloy substrate, wherein the superalloy substrate comprises nickel and/or cobalt-containing base metal; and thereafter, applying an acid solution to the surface of the superalloy substrate, wherein the acid solution comprises a citrate-based organic acid;

thereafter, applying a permanganate solution onto the surface of the superalloy substrate; and thereafter, applying a ferric chloride based cleaning composition onto the surface of the superalloy substrate, wherein the ferric chloride based cleaning composition comprises an aqueous solution of ferric chloride, nitric acid, and phosphoric acid.

15. The method of claim 14, wherein the ferric chloride based cleaning composition comprises about 130 g/L to about 160 g/L ferric chloride, about 95 g/L to about 115 g/L nitric acid, and about 115 g/L to about 145 g/L phosphoric acid.

16. The method of claim 14, further comprising:

repeating a series of applying the permanganate solution onto the surface of the superalloy substrate and then applying the ferric chloride based cleaning composition onto the surface of the superalloy substrate.

17. The method of claim 16, wherein the series is repeated for at least 5 cycles.

18. The method of claim 14, wherein applying the ferric chloride based cleaning composition onto the surface of the superalloy substrate comprises immersing the superalloy substrate into the ferric chloride based cleaning composition.

19. A method of cleaning a superalloy substrate having engine deposits on its surface, the method comprising:

applying an alkaline solution to the surface of the superalloy substrate, wherein the alkaline solution comprises sodium hydroxide, sodium gluconate, and a surfactant;

thereafter, applying an acid solution to the surface of the superalloy substrate;

thereafter, applying a permanganate solution onto the surface of the superalloy substrate; and applying a ferric chloride based cleaning composition onto the surface of the superalloy substrate, wherein the ferric chloride based cleaning composition comprises ferric chloride and at least one of nitric acid and phosphoric acid.

20. The method of claim 19, wherein the ferric chloride based cleaning composition comprises ferric chloride, nitric acid, phosphoric acid, and a solvent system.

* * * * *